US008020853B2

(12) United States Patent
Shiraki et al.

(10) Patent No.: US 8,020,853 B2
(45) Date of Patent: Sep. 20, 2011

(54) IMAGE FORMING APPARATUS AND SHEET FEEDING APPARATUS

(75) Inventors: Masatoshi Shiraki, Nissin (JP); Hiroki Mori, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 213 days.

(21) Appl. No.: 12/038,457

(22) Filed: Feb. 27, 2008

(65) Prior Publication Data

US 2008/0217840 A1 Sep. 11, 2008

(30) Foreign Application Priority Data

Feb. 27, 2007 (JP) ..... 2007-047354

(51) Int. Cl.
*B65H 1/08* (2006.01)

(52) U.S. Cl. ..... 271/127; 271/147

(58) Field of Classification Search ..... 271/117, 271/126, 127, 147
See application file for complete search history.

(56) References Cited

U.S. PATENT DOCUMENTS 615,502 A * 12/1898 Shade ..... 271/121
3,588,106 A * 6/1971 Csaba et al. ..... 271/170
4,936,695 A * 6/1990 Ishii ..... 400/605
5,181,712 A * 1/1993 Perino ..... 271/109
5,326,091 A * 7/1994 Giacometto et al. ..... 271/10.01
6,032,946 A * 3/2000 Marshall et al. ..... 271/152
7,427,062 B2 * 9/2008 Jang ..... 271/124
2004/0041332 A1 * 3/2004 Kamimura et al. ..... 271/121

FOREIGN PATENT DOCUMENTS

JP 59039638 A * 3/1984
JP 62046823 A * 2/1987
JP 05-058474 3/1993
JP 05-085744 11/1993
JP 06016266 A * 1/1994
JP 2000-326588 11/2000
JP 2000-351453 12/2000

* cited by examiner

*Primary Examiner* — Michael McCullough
(74) *Attorney, Agent, or Firm* — Banner & Witcoff, Ltd.

(57) ABSTRACT

An apparatus is provided. The apparatus includes a sheet housing unit which houses a recording sheet and which includes an opening portion formed on an upper end side thereof; a cover member configured to open and close the opening portion; a feed roller which feeds the recording sheet housed in the sheet housing unit; a push member provided in the sheet housing unit configured to push the recording sheet housed in the sheet housing unit toward the feed roller while moving between a distal position spaced apart from the feed roller and a proximal position closer to the feed roller than the distal position; a force application mechanism which provides a push force to the push member; and a cooperation mechanism which displaces the push member from the proximal position to the distal position cooperatively with the cover member being opened.

15 Claims, 9 Drawing Sheets

IMAGE FORMING APPARATUS AND SHEET FEEDING APPARATUS

CROSS-REFERENCE TO RELATED APPLICATION

This application claims priority from Japanese Patent Application No. 2007-047354, filed on Feb. 27, 2007, the entire subject matter of which is incorporated herein by reference.

TECHNICAL FIELD

Aspects of the present invention relate to an image forming apparatus and a sheet feeding apparatus.

BACKGROUND

Japanese Patent Application No. JP-A-2000-326588 describes a related-art image forming apparatus which includes a sheet housing unit for stacking and housing a recording sheet generally upright in the vertical direction, which is fed to an image forming unit, and a cover supported to be capable of being opened and closed on the upper portion of the sheet housing unit. The cover is closed to cover an upper end side of the housed recording sheet.

Such a configuration allows the recording sheet to be housed upright in the sheet housing unit by supplying (housing) it from the upper end side of the recording sheet. This makes it possible to reduce the size of the sheet housing unit in the horizontal direction. In other words, this makes it possible to reduce the footprint of the overall image forming apparatus on, for example, a desktop.

Moreover, the image forming apparatus described in JP-A-2000-326588 includes the cover which opens and closes the sheet housing unit on the upper end side of a recording sheet, and this configuration allows for a reduction in size of the sheet housing unit in the horizontal direction.

To reliably feed recording sheets, it is advantageous to provide a push member which pushes a recording sheet toward a pick-up roller which takes the recording sheet out of the sheet housing unit.

However, when compared with an image forming apparatus in which sheets are supplied from a side of the image forming apparatus, an opening portion through which a recording sheet is placed tends to be narrower in the image forming apparatus with a sheet housing unit which accommodates generally vertical sheets. Thus, since the push member is supplied in the sheet feeding unit, it is difficult to supply recording sheets in the presence of the push member in the sheet housing unit, because the presence of the push member hinders the recording sheets from being received.

Thus, implementing a push member in the narrower recording sheet space of a vertical sheet feeding image forming apparatus causes a difficulty in that recording sheets are hindered from being easily put into the sheet holding unit.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image forming apparatus and a sheet feeding apparatus which facilitate accommodation of recording sheets in a sheet housing unit.

According to an exemplary embodiment of the present invention, there is provided an image forming apparatus including an image forming unit which forms an image on a recording sheet, a sheet housing unit which houses the recording sheet so that a recording surface of the recording sheet intersects with a horizontal plane, and which includes an opening portion formed on an upper end side thereof; a cover member configured to open and close the opening portion; a feed roller which feeds the recording sheet housed in the sheet housing unit to the image forming unit; a push member provided in the sheet housing unit configured to push the recording sheet housed in the sheet housing unit toward the feed roller while moving between a distal position spaced apart from the feed roller and a proximal position closer to the feed roller than the distal position; a force application mechanism which provides a push force to the push member; and a cooperation mechanism which displaces the push member from the proximal position to the distal position cooperatively with the cover member being opened.

According to another exemplary embodiment of the present invention, there is provided an sheet feeding apparatus which includes a sheet housing unit which houses a recording sheet so that a recording surface of the recording sheet intersects with a horizontal plane, and which includes an opening portion formed on an upper end side thereof, a cover member configured to open and close the opening portion, a feed roller which feeds the recording sheet housed in the sheet housing unit, a push member provided in the sheet housing unit configured to push the recording sheet housed in the sheet housing unit toward the feed roller while moving between a distal position spaced apart from the feed roller and a proximal position closer to the feed roller than the distal position, a force application mechanism which provides a push force to the push member, and a cooperation mechanism which displaces the push member from the proximal position to the distal position cooperatively with the cover member being opened.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Exemplary embodiments of the present invention will be explained below with reference to the accompanying drawings.

[General Configuration of Image Forming Apparatus]

Figure 1A:
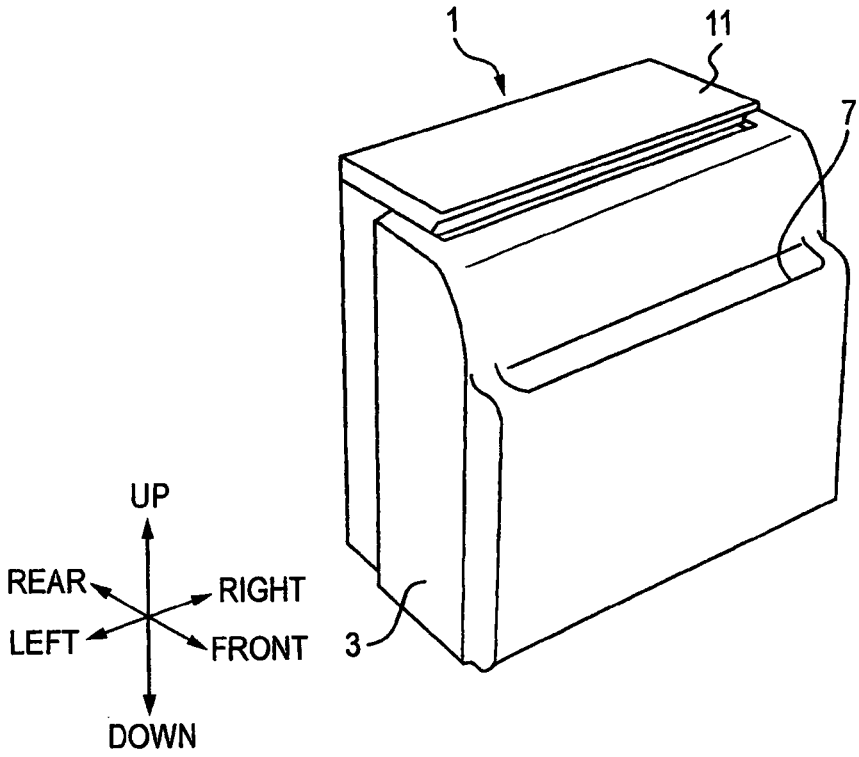
FIG. 1A is an overall perspective view illustrating an image forming apparatus according to an exemplary embodiment of the present invention.
Figure 1B:
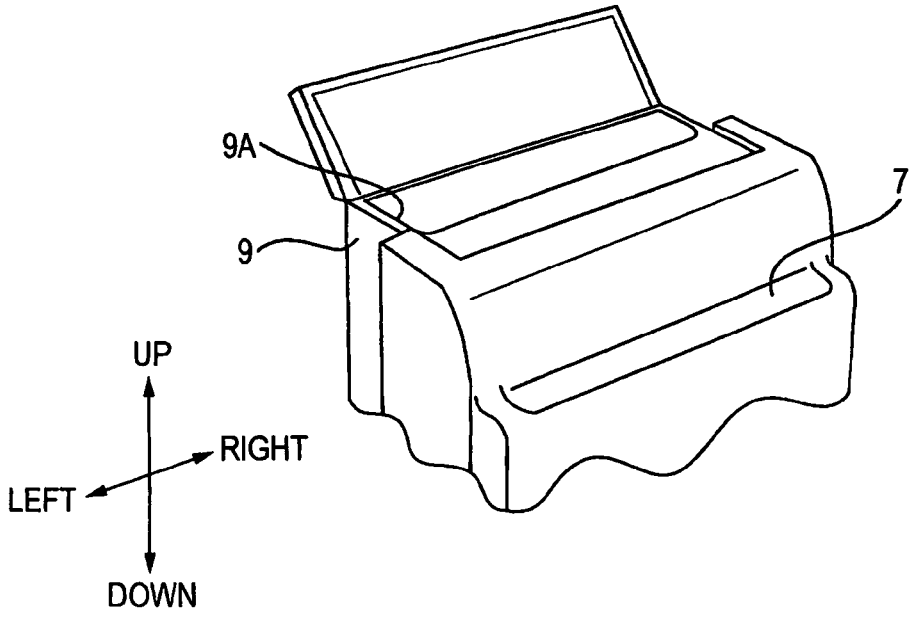
FIG. 1B is a perspective view illustrating the upper end portion of the image forming apparatus in an open configuration according to an exemplary embodiment of the present invention.
Figure 2:
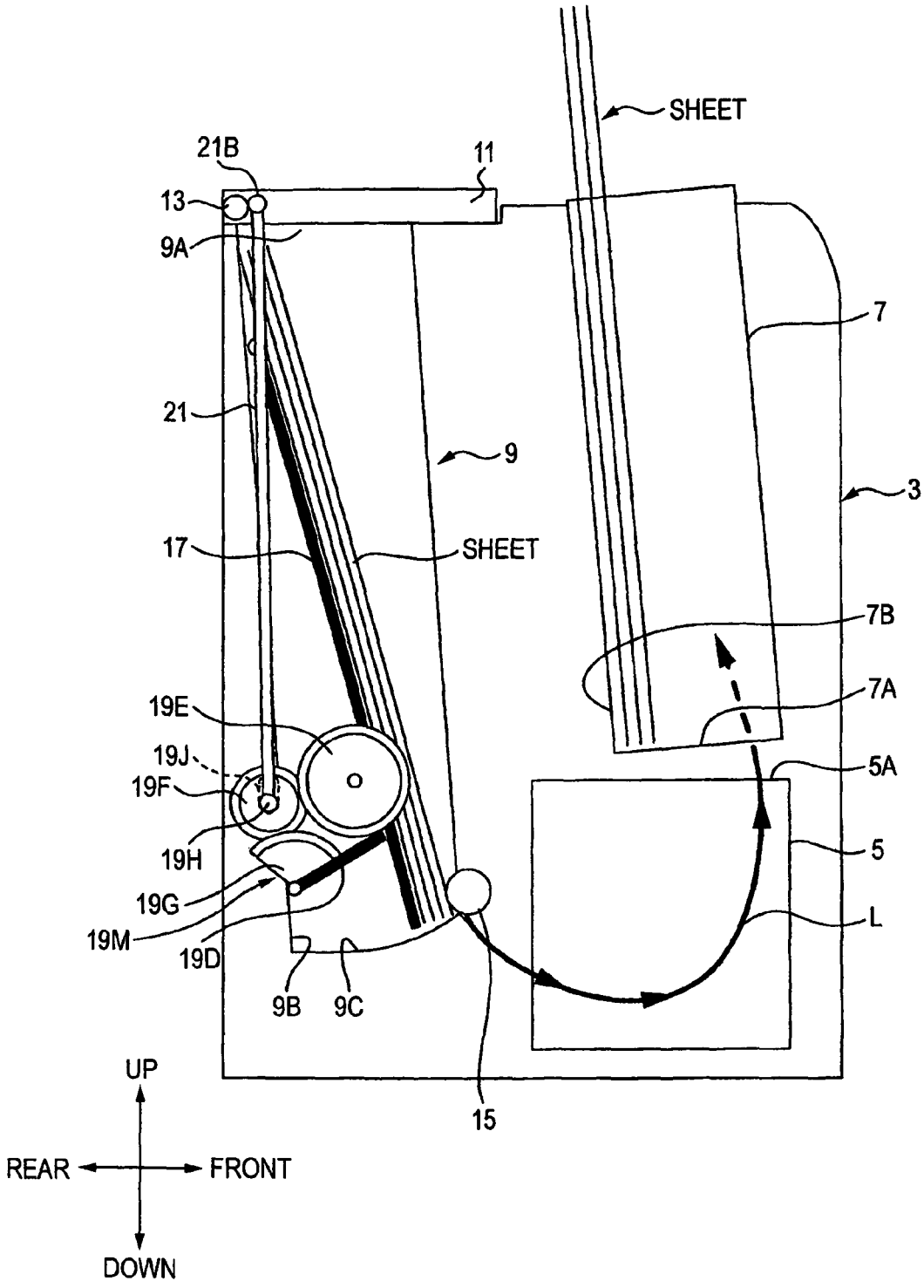
FIG. 2 is a schematic view illustrating the general configuration of the image forming apparatus according to an exemplary embodiment of the present invention.

As shown in FIG. 2, the image forming apparatus 1 according to this exemplary embodiment is an upright image forming apparatus configured such that a conveying path L for a recording sheet such as a piece of recording paper (hereinafter referred to as a sheet) is formed generally in the shape of a letter U to be protruded downwardly. Included in the lower portion of a housing 3 is an image forming unit 5 of an electrophotographic scheme for forming an image on a conveyed sheet.

Furthermore, provided above a sheet discharging unit 5A of the image forming unit 5 is a discharged-sheet housing unit 7 for housing a sheet discharged from the sheet discharging unit 5A. A sheet receive face 7A provided at the lower portion (bottom) of the discharged-sheet housing unit 7 is configured to tilt with respect to a horizontal plane in the rear and front direction of the image forming apparatus 1 so as to be lowered from the front toward the rear.

As indicated with a dashed arrow, the sheet is discharged upwardly rearward from the sheet discharging unit 5A. Thus, the sheet discharged to the discharged-sheet housing unit 7 is guided by the tilted sheet receive face 7A to a lowest end portion 7B of the discharged-sheet housing unit 7 and then placed to be stacked generally in the horizontal direction.

Furthermore, inside the housing 3, provided at a portion spaced apart horizontally rearward from the discharged-sheet housing unit 7 is an upright sheet housing unit 9 for housing sheets so that the recording surface of a sheet is slightly tilted with respect to a vertical plane. At the upper end of the sheet housing unit 9, i.e., at the upper end side of the sheet housed in the sheet housing unit 9, there is formed an opening portion 9A through which sheets are inserted into the sheet housing unit 9.

Figure 5:
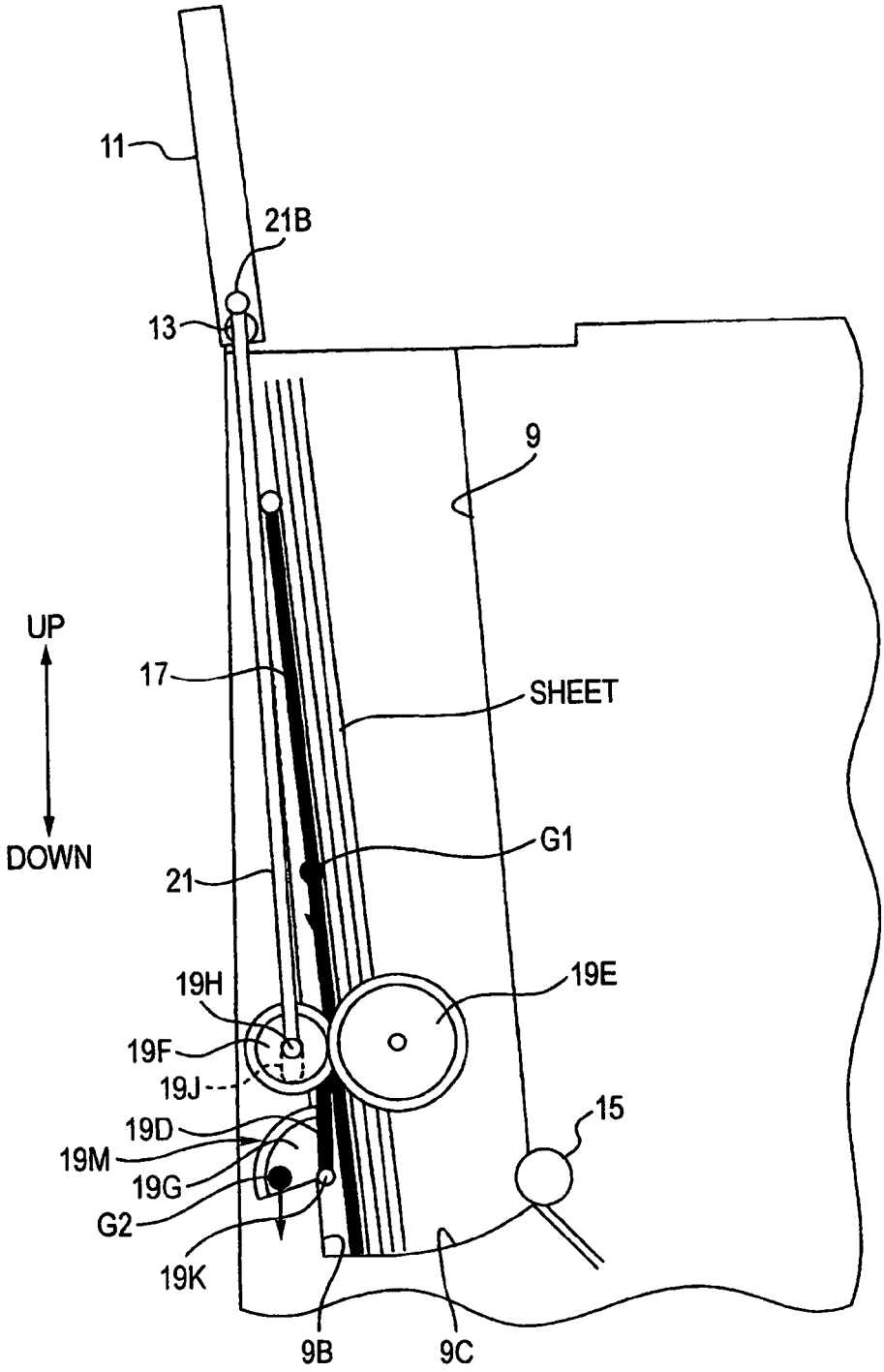
FIG. 5 is an explanatory view illustrating the operation of the force application mechanism and the push member according to an exemplary embodiment of the present invention.

Then, a cover member 11 for opening or closing the opening portion 9A is pivotally supported on the housing 3 via a hinge mechanism 13 to be pivotable between the position at which the upper end of the sheet housed in the sheet housing unit 9 is covered, i.e., a closed position, (see FIG. 6) and the position at which the opening portion 9A is opened for the sheet housing unit 9 to be exposed, i.e., an open position, (see FIG. 5).

Furthermore, provided at the lower end side of the sheet housing unit 9 near the image forming unit 5 is a feed roller 15 for feeding a sheet housed in the sheet housing unit 9 toward the image forming unit 5. On the other hand, provided opposite to the feed roller 15 across the sheet housing unit 9 is the push member 17 which pushes a sheet housed in the sheet housing unit 9 toward the feed roller 15.

In addition, the push member 17 is pivotally attached to a wall surface 9B inside the sheet housing unit 9 opposite to the feed roller 15, and is pivotally displaced between a distal position spaced apart from the feed roller 15 (see FIG. 6) and a proximal position spaced closer to the feed roller 15 than the distal position is (see FIG. 7) to push a sheet toward the feed roller 15.

Figure 3:
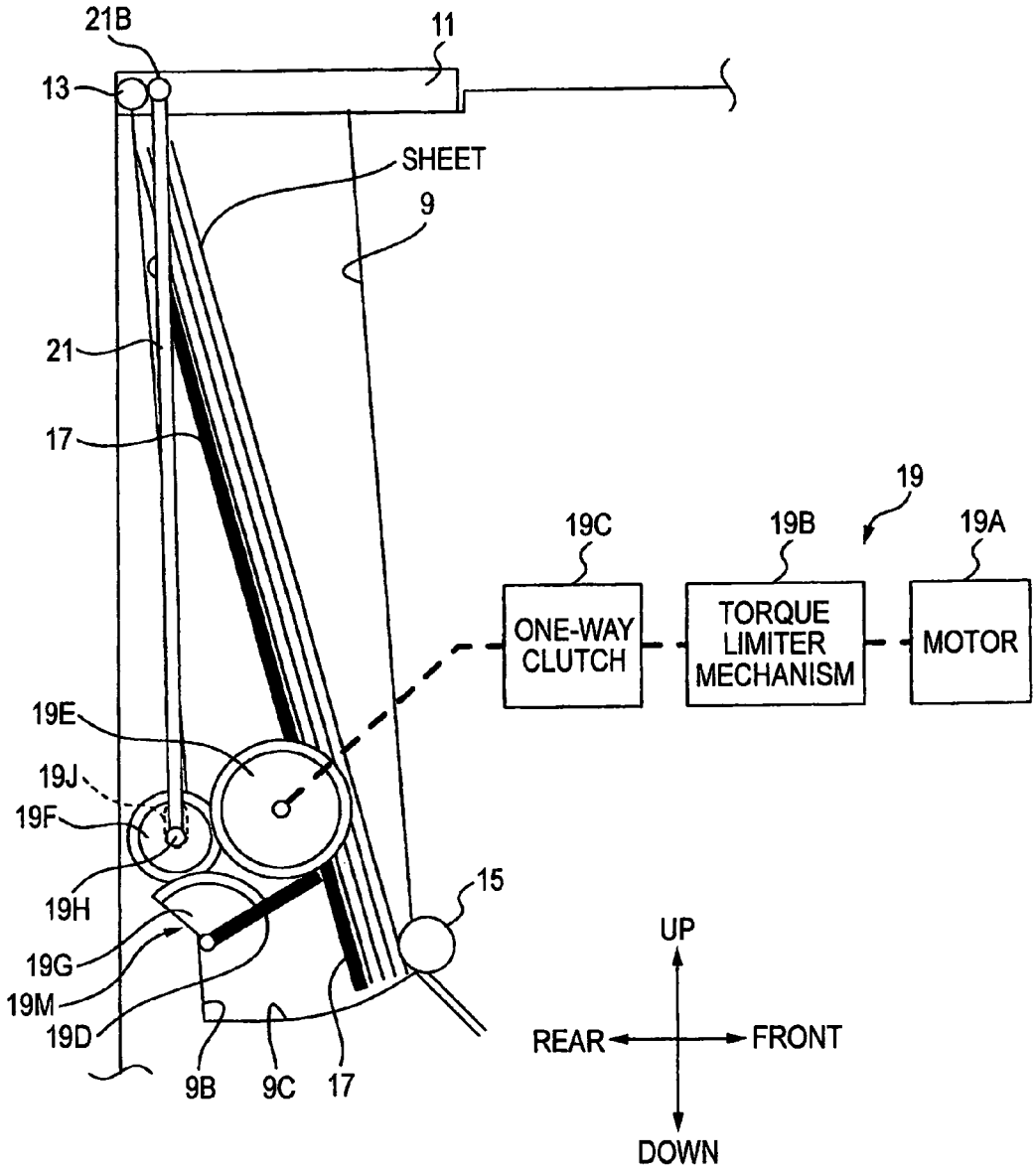
FIG. 3 is a schematic view illustrating the general configuration of a force application mechanism according to an exemplary embodiment of the present invention.

Furthermore, as shown in FIG. 3, provided at the bottom of the sheet housing unit 9 is a restricting face 9C which is in contact with the lower end of a sheet housed in the sheet housing unit 9 to restrict the position of a housed sheet. The restricting face 9C is curved to tilt upwardly, with respect to a horizontal plane, from the wall surface 9B toward the feed roller 15.

Furthermore, the force application mechanism 19 provides push force to the push member 17. The force application mechanism 19 comprises an electric motor 19A, a torque limiter mechanism 19B, a one-way clutch 19C, an active member 19D, and a plurality of gears 19E to 19G. These components 19A to 19G are disposed in series in the drive force transfer path leading from the motor 19A to the active member 19D.

The torque limiter mechanism 19B is a mechanical push force adjustment unit for interrupting the transfer of drive force when the drive force transferred from the motor 19A to the push member 17 is equal to or greater than a threshold value, thereby adjusting the push force provided by the push member 17. The threshold value may be predetermined. It is advantageous to maintain the push force such that the push force is generally constant.

The one-way clutch 19C is a mechanical one-way drive force transfer unit which permits the transfer of drive force from the motor 19A to the gears 19E to 19G and conversely, interrupts the transfer of drive force from the gears 19E to 19G to the motor 19A.

Figure 9:
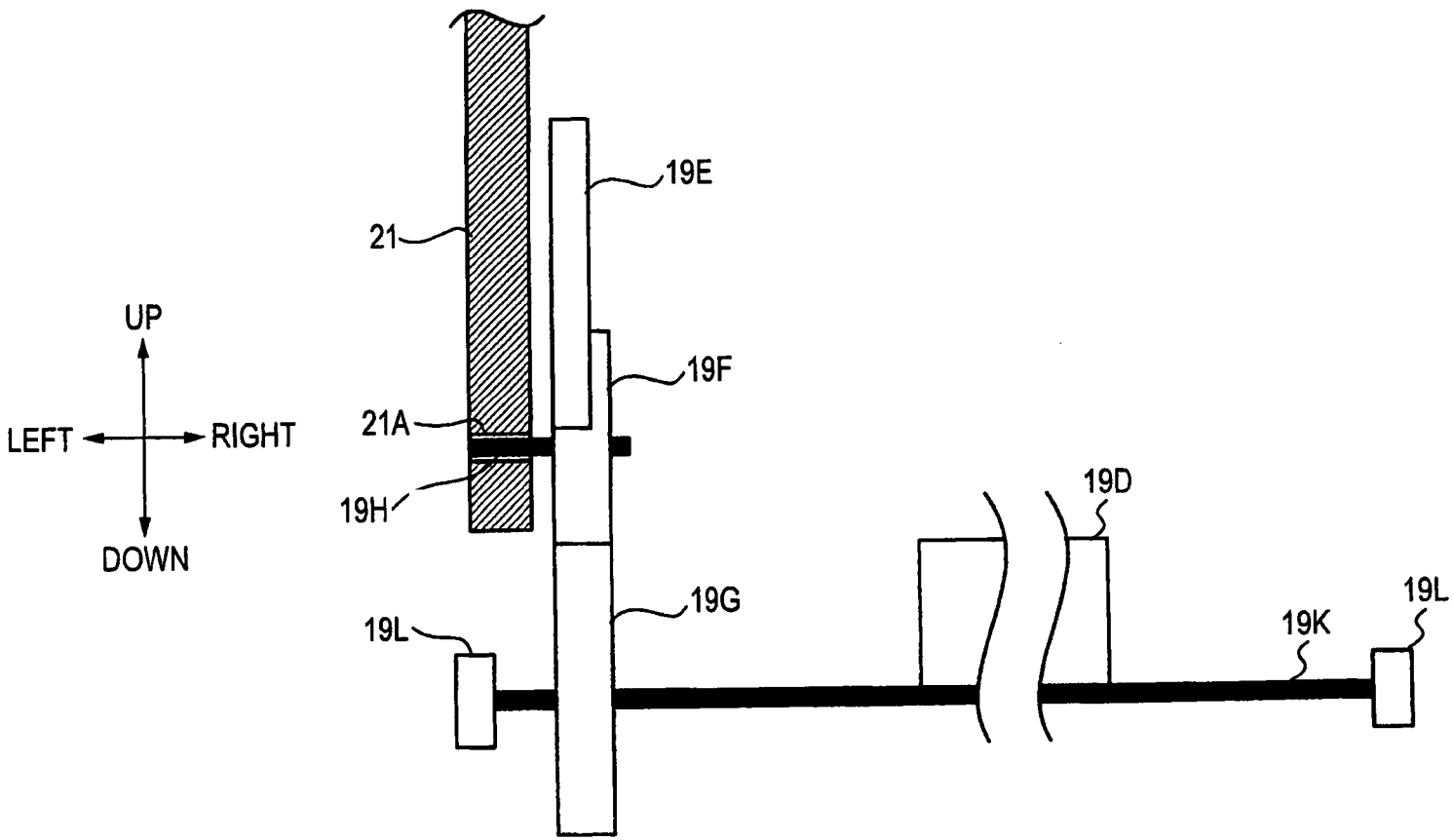
FIG. 9 is an explanatory view illustrating the operation of the force application mechanism and the push member according to an exemplary embodiment of the present invention.

The active member 19D is in contact with the push member 17 to apply a push force to the push member 17. As shown in FIG. 9, the active member 19D is fixed to a shaft 19K which extends in the direction of width of the sheet (in the right and left direction of the image forming apparatus 1 in this exemplary embodiment). The shaft 19K is rotatably (pivotally) supported via bearings 19L which are attached at the axial ends. In addition, the bearings 19L are secured to the housing 3 or a frame member (not shown).

The plurality of gears 19E to 19G are a transfer unit for transferring drive force produced by the motor 19A to the active member 19D. These gears 19E to 19G are provided only on one side in the direction of width of the sheet (on the left end side of the image forming apparatus 1 in this exemplary embodiment as shown in FIG. 8).

The plurality of gears 19E to 19G comprises an input gear 19E disposed closer to the motor 19A in the drive force transfer path leading from the motor 19A to the active member 19D; an output gear 19G which is shaped like a sector and coupled only to one axial end of the shaft 19K to directly transfer drive force to the active member 19D; and an intermediate gear 19F for transferring drive force from the input gear 19E to the output gear 19G.

Figure 8:
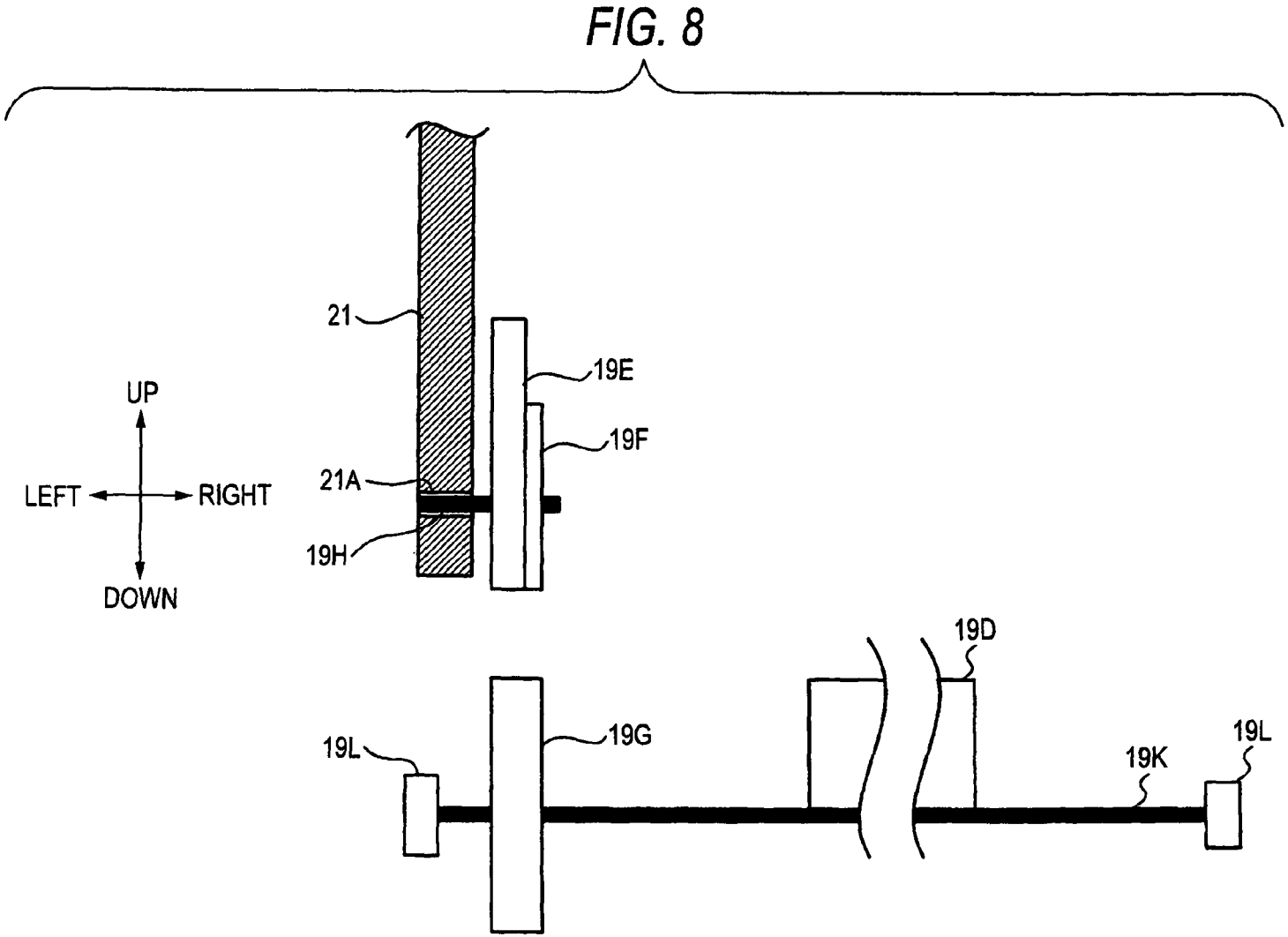
FIG. 8 is an explanatory view illustrating the operation of the force application mechanism and the push member according to an exemplary embodiment of the present invention.

In addition, since the active member 19D, the shaft 19K, and the output gear 19G are integrally rotated (pivoted), the active member 19D, the shaft 19K, and the output gear 19G are collectively referred to as a pivotally operative assembly 19M (see FIG. 8).

Figure 4:
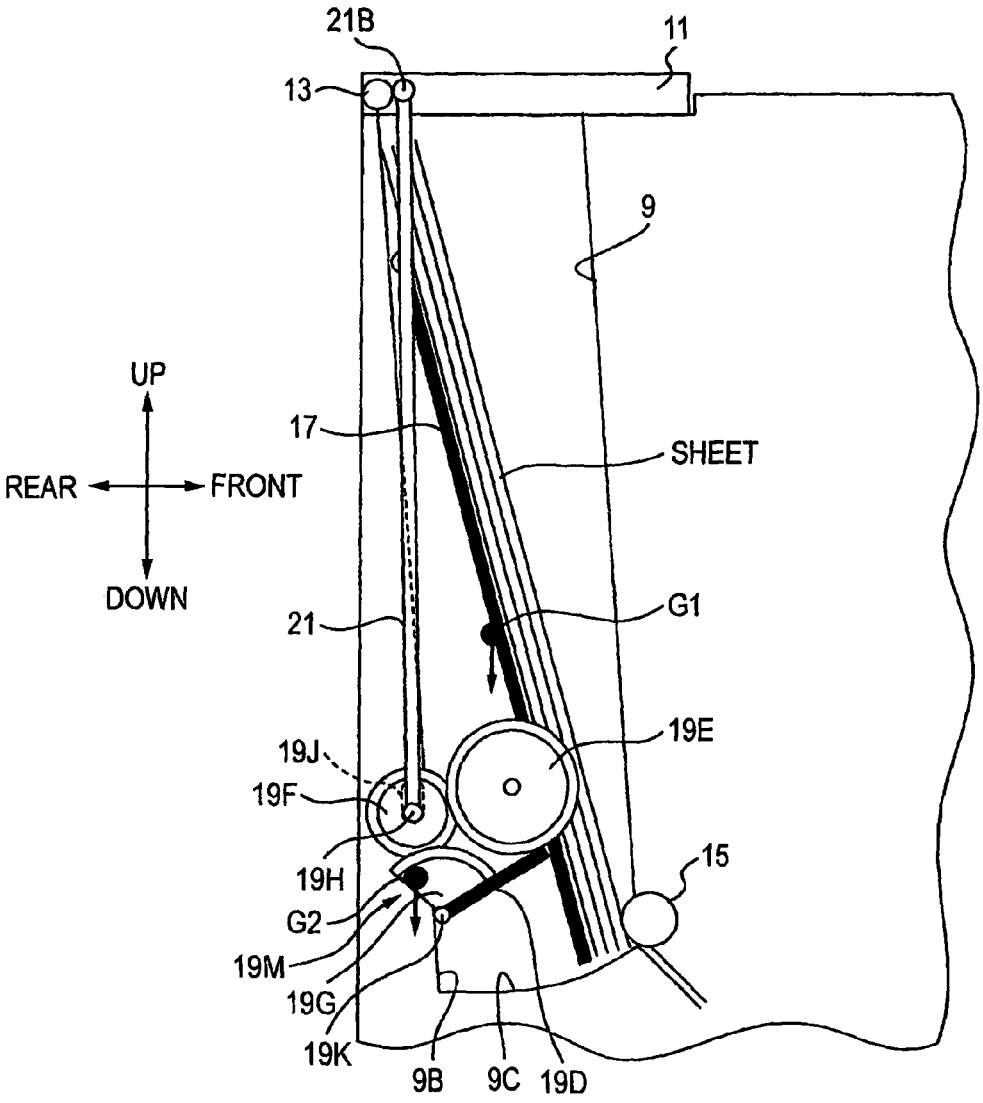
FIG. 4 is an explanatory view illustrating the operation of the force application mechanism and a push member according to an exemplary embodiment of the present invention.
Figure 6:
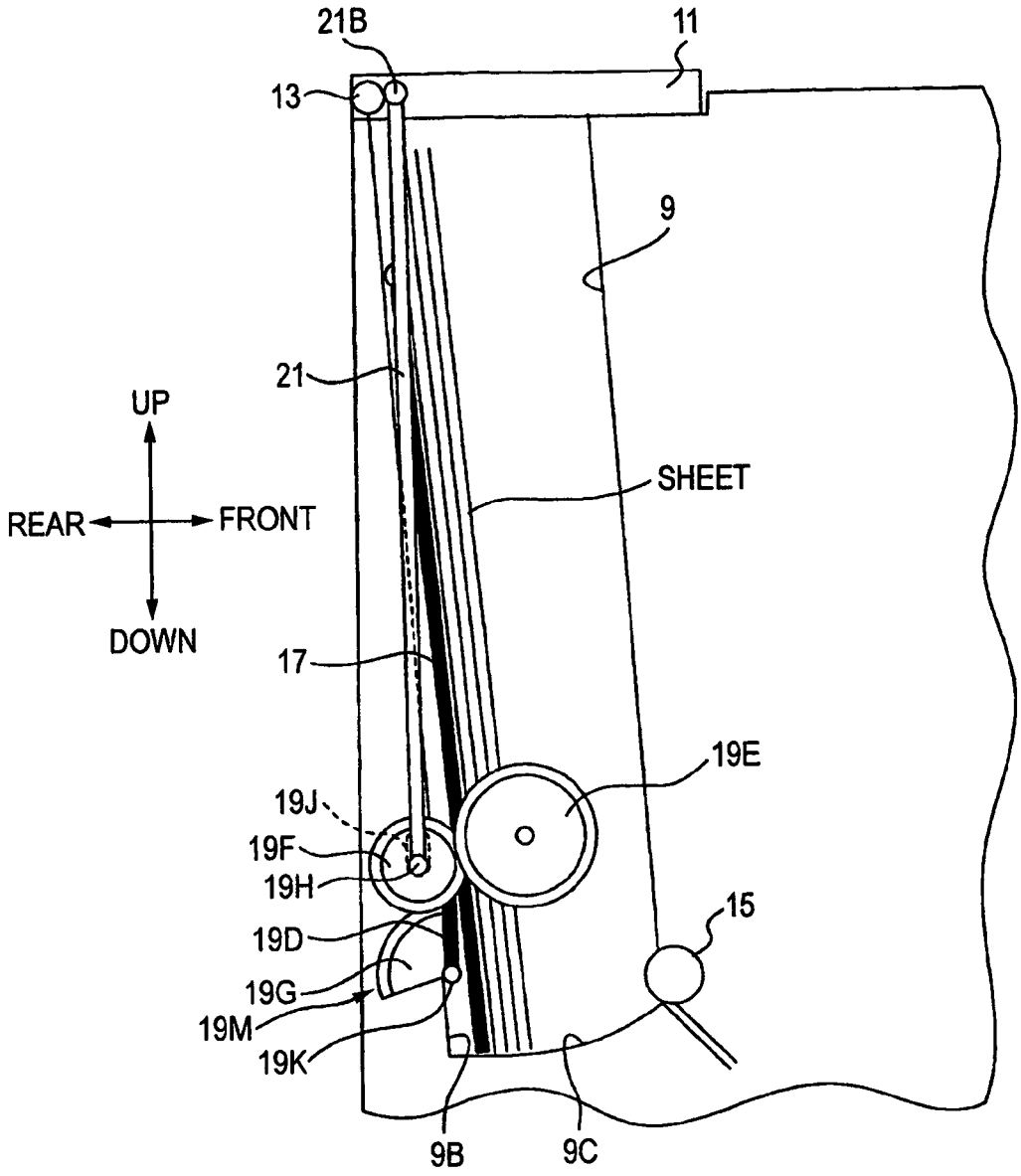
FIG. 6 is an explanatory view illustrating the operation of the force application mechanism and the push member according to an exemplary embodiment of the present invention.

Furthermore, as shown in FIG. 4, the positions of the center of gravity G1 of the push member 17 and the center of gravity G2 of the pivotally operative assembly 19M allow the gravitational force to act upon each of the push member 17 and the pivotally operative assembly 19M in a manner such that the push member 17 and the pivotally operative assembly 19M are displaced toward the distal position (see FIG. 6).

More specifically, when the push member 17 is at the proximal position, the push member 17 is tilted with respect to a vertical plane and the center of gravity G2 of the pivotally operative assembly 19M is positioned opposite to the feed roller 15 across the shaft 19K. That is, the shaft 19K is located between the feed roller 15 and the center of gravity G2 of the pivotally operative assembly 19M.

Furthermore, as shown in FIG. 3, with a rotational shaft 19H of the intermediate gear 19F disposed parallel to the direction of width of the sheet, the rotational shaft 19H is supported to be displaceable in the vertical direction by an oblong-hole shaped bearing unit 19J extending generally in the vertical direction. Additionally, one axial end of the shaft is rotatably coupled to a connecting link 21 which is in turn rotatably coupled to the cover member 11. In addition, the bearing unit 19J is provided on the housing 3 or the frame member.

Further, the connecting link 21 may be formed of SPCC (cold rolled steel plate) or of a material having relatively high flexural rigidity such as resin. As shown in FIG. 9, a hole 21A of the connecting link 21 into which the rotational shaft 19H is inserted comprises a sliding bearing for rotatably supporting the rotational shaft 19H. On the other hand, as shown in FIG. 3, the connecting link 21 on the cover member 11 side is rotatably coupled to the cover member 11 via a pin 21B.

In this regard, in this exemplary embodiment, the pin 21B is fixed to the cover member 11 and allowed to rotate relative to the connecting link 21. However, it is also possible to alternatively configure the pin 21B so that the pin 21B is fixed to the connecting link 21, and the pin 21B rotates relative to the cover member 11.

[Operation of an Image Forming Apparatus]

In this exemplary embodiment, the intermediate gear 19F is supported to be displaceable in the vertical direction, the rotational shaft 19H of the intermediate gear 19F is coupled to one longitudinal end of the connecting link 21, and the other longitudinal end of the connecting link 21 is coupled to the cover member 11. Thus, the intermediate gear 19F mechanically cooperatively moves up and down as the cover member 11 is opened or closed.

That is, as shown in FIGS. 5 and 6, with the cover member 11 closed (see FIG. 6), the intermediate gear 19F is lowered to mate with the input gear 19E and the output gear 19G in contrast to the cover member 11 in an open position (see FIG. 5).

At this time, the self weight of the connecting link 21 and the cover member 11 acts upon the rotational shaft 19H (and hence, on the intermediate gear 19F) via the connecting link 21. This causes the intermediate gear 19F to be pushed toward the input gear 19E and the output gear 19G, so that the intermediate gear 19F remains mated with the input gear 19E and the output gear 19G.

Figure 7:
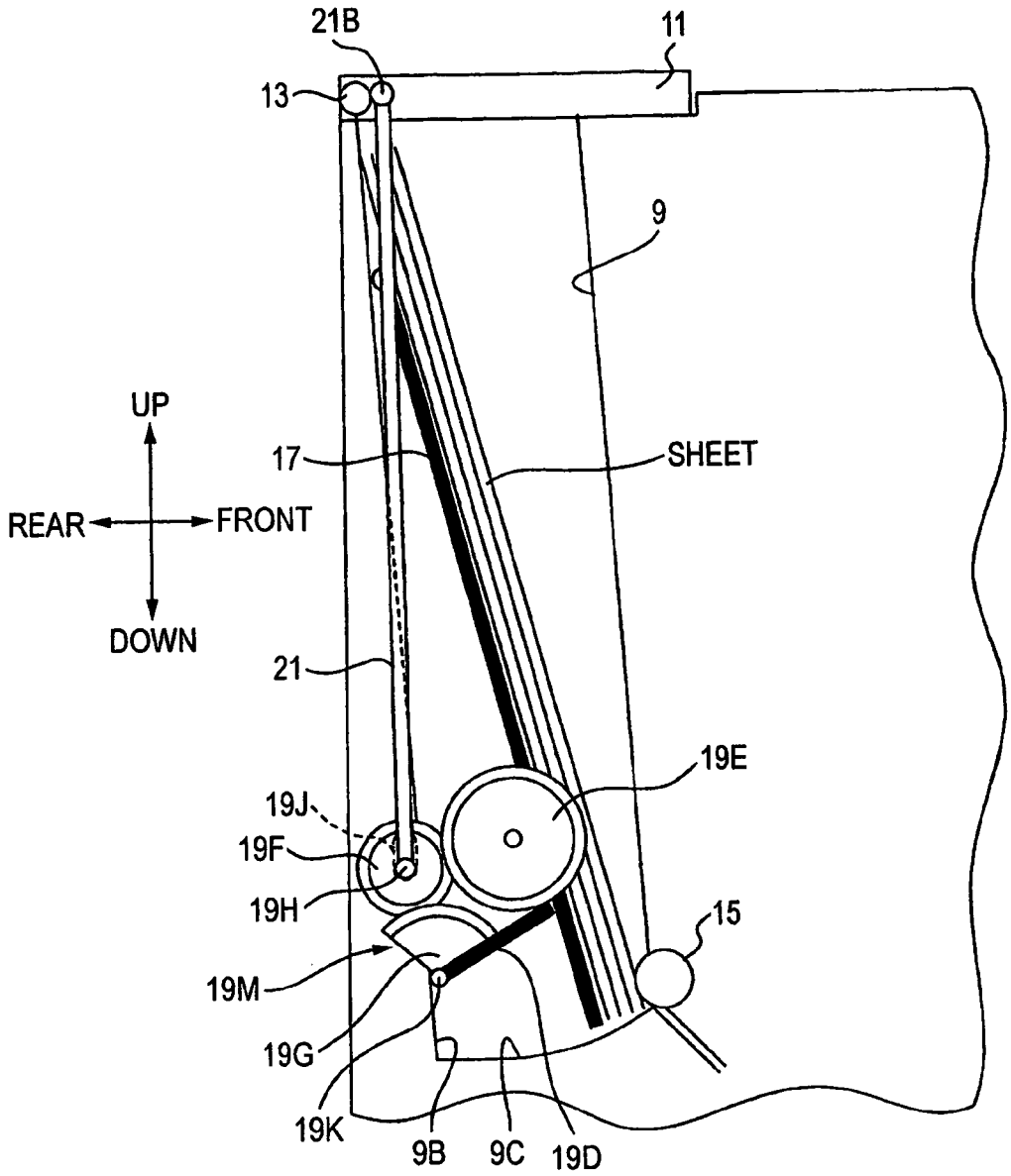
FIG. 7 is an explanatory view illustrating the operation of the force application mechanism and the push member according to an exemplary embodiment of the present invention.

Then, when an image starts to be formed (printed), the motor 19A starts to rotate. Thus, as shown in FIG. 7, the push member 17 starts to displace toward the feed roller 15, thereby causing a sheet housed in the sheet housing unit 9 to be pushed toward the feed roller 15 by the push member 17. Subsequently, the sheet forced by the feed roller 15 is conveyed into the image forming unit 5 to form an image thereon and thereafter, discharged to the discharged-sheet housing unit 7.

Furthermore, as shown in FIGS. 5 and 6, with the cover member 11 in an open position (see FIG. 5), the intermediate gear 19F is raised compared to the case in FIG. 6 in which the cover member 11 closed. Thus, when the cover member 11 is opened, the intermediate gear 19F is displaced upwardly as the cover member 11 is opened. This causes the intermediate gear 19F to be disengaged from the output gear 19G, thereby interrupting the power transfer path leading from the motor 19A to the active member 19D.

At this time, the gravitational force that acts upon the center of gravity G1 of the push member 17 and the center of gravity G2 of the pivotally operative assembly 19M forces each of the push member 17 and the pivotally operative assembly 19M so that the push member 17 is pushed back to the distal position (see FIG. 5). Therefore, when the cover member 11 is opened and the power transfer path is interrupted, the push member 17 and the pivotally operative assembly 19M swing back toward the distal position (see FIG. 5).

That is, in this exemplary embodiment, the connecting link 21 serves as a gang mechanism which cooperates with the cover member 11 being opened, thereby causing the push member 17 to displace from the proximal position (compare for example, FIGS. 5 and 7) to a position away from the feed roller 15.

In this exemplary embodiment, when the cover member 11 is opened to receive recording sheets in the sheet housing unit 9, the push member 17 displaces away from the feed roller 15 when the cover member 11 is opened.

As such, in this exemplary embodiment, the push member 17 displaces to a position away from the feed roller 15 to create a space to accommodate recording sheets between the push member 17 and the feed roller 15, thereby facilitating accommodation of recording sheets in the sheet housing unit 9. Moreover, the operation of opening the cover member 11 can cause the push member 17 to be spaced apart from the feed roller 15, thereby ensuring a higher degree of operability.

Furthermore, in this exemplary embodiment, the input gear 19E is disengaged from the intermediate gear 19F and the output gear 19G is disengaged from the intermediate gear 19F cooperatively with the cover member 11 being opened to thereby interrupt the transfer of drive force. Thus, when the cover member 11 is opened to receive recording sheets in the sheet housing unit 9, no push force is exerted on the push member 17.

This arrangement allows the push member 17 to readily displace away from the feed roller 15, thereby making it possible to facilitate accommodation of recording sheets in the sheet housing unit 9.

This exemplary embodiment is also configured such that when the transfer of drive force is interrupted, the gravitational force acting upon the push member 17 and the gravitational force acting upon the pivotally operative assembly 19M cause the push member 17 to displace toward the distal position. Thus, when the cover member 11 is opened to receive recording sheets in the sheet housing unit 9, the gravitational force acting upon the push member 17 and the pivotally operative assembly 19M will allow the push member 17 to automatically displace toward the distal position.

It is thus possible to facilitate accommodation of recording sheets in the sheet housing unit 9 and simplify the configuration of the device.

Furthermore, in this exemplary embodiment, the torque limiter mechanism 19B maintains a generally constant push force. Thus, for example, compared with a case where an elastic unit such as a spring provides push force to the push member 17, recording sheets housed in the sheet housing unit 9 can be pushed toward the feed roller 15 with improved stability.

By providing the intermediate gear 19F in this exemplary embodiment, the mass to be displaced is decreased, and thus the actuating force for producing the displacement is decreased. Accordingly, the cover member 11 may be more easily opened.

This exemplary embodiment is adapted such that the intermediate gear 19F is displaced cooperatively with the cover member 11 being opened to interrupt the transfer of drive force. This eliminates the need for displacing directly the heavy objects such as the output gear 19G, the active member 19D, and the shaft 19K.

Thus, there is no such problem that an unnecessary increase in the number of parts to be moved causes degradation in positioning accuracy of those members and an increase in the actuating force for moving those members. Accordingly, the image forming apparatus 1 can be configured in a simple structure.

Moreover, in this exemplary embodiment, only the intermediate gear 19F is displaced, thereby allowing for providing the connecting link 21 only on one end in the direction of width of the recording sheets housed in the sheet housing unit 9. It is thus possible to simplify the image forming apparatus 1.

Furthermore, in this exemplary embodiment, the gears 19E to 19G are mated with each other cooperatively with the cover member 11 being closed and their engagement is maintained. It is thus possible to ensure the operation of the force application mechanism 19.

The sheets housed in the discharged-sheet housing unit 7 are not restricted to any particular position in the discharged-sheet housing unit 7 when fed therein. This may cause the lower ends of sheet bundles to be spaced apart from each other due to the self weight of the sheets. This may also cause the lower end of the recording sheets to be inappropriately positioned, resulting in the sheets being improperly conveyed by the feed roller 15.

In contrast to this, this exemplary embodiment is adapted such that the restricting face 9C is tilted with respect to a horizontal plane so as to be oriented upwardly from the push member 17 toward the feed roller 15. This allows the tilted restricting face 9C to prevent the lower end of the recording sheets from moving due to the gravitational force. Accordingly, the lower end of the recording sheets is prevented from unnecessarily moving, thereby avoiding the occurrence of the aforementioned problems.

Additional Exemplary Embodiments

The aforementioned exemplary embodiment is configured such that the gravitational force acting upon the push member 17 and the pivotally operative assembly 19M can cause the push member 17 to be displaced to the distal position; however, the present invention is not limited thereto. For example, in another exemplary embodiment, a biasing unit utilizing an elastic force of a spring or the like, or an electric actuator may also be employed to allow the push member 17 to be displaced to the distal position.

Moreover, in another exemplary embodiment, a safe guard may be provided to lock and prevent the cover member 11 from being opened when the motor 19A is rotated.

Furthermore, the aforementioned exemplary embodiment is adapted such that the self weight of the cover member 11 is utilized to hold the gears 19E to 19G mated with each other; however, the present invention is not limited thereto. For example, in another exemplary embodiment, a lock mechanism for locking and thereby preventing the cover member 11 from being opened may also be used to keep the gears engaged with each other.

Furthermore, the aforementioned exemplary embodiment is adapted such that the active member 19D, the shaft 19K, and the output gear 19G are integrated to define the center of gravity G2 of the integrated assembly so that the pivotally operative assembly 19M returns to the distal position; however, the present invention is not limited thereto. In another exemplary embodiment, a center of gravity of the active member 19D may be set to the position at which the active member 19D returns to the distal position.

Furthermore, when the cover member 11 is operated, the intermediate gear 19F may be displaced while engaging the input gear 19E at any time. In this case, the intermediate gear 19F engages the input gear 19E not only when the cover member 11 is closed but also when the cover member 11 is opened. Also, when the cover member 11 is operated, the intermediate gear 19F may be displaced so that the rotational shaft 19H of the intermediate gear 19F may turn about a rotational shaft of the input gear 19E. According to these configurations, the intermediate gear 19F engages the input gear 19E at any time, and therefore, the engagement can be reliable. In this case, a support unit such as the bearing unit 19J may be provided to support the intermediate gear 19F to be displaced in the above-described manner. In the exemplary embodiments, the bearing unit 19J may serve as a guide unit which has a shape to guide the intermediate gear 19F to be displaced in the above-described manner.

Furthermore, the present invention is not limited to the aforementioned exemplary embodiments, and various modifications may be made thereto without deviating from the scope and spirit of the invention set forth in the claims.

According to an aspect of the present invention, an image forming apparatus is provided which includes: an image forming unit which forms an image on a recording sheet; a sheet housing unit which houses the recording sheet so that a recording surface of the recording sheet intersects with a horizontal plane, and which includes an opening portion formed on an upper end side thereof; a cover member configured to open and close the opening portion; a feed roller which feeds the recording sheet housed in the sheet housing unit to the image forming unit; a push member provided in the sheet housing unit configured to push the recording sheet housed in the sheet housing unit toward the feed roller while moving between a distal position spaced apart from the feed roller and a proximal position closer to the feed roller than the distal position; a force application mechanism which provides a push force to the push member; and a cooperation mechanism which displaces the push member from the proximal position to the distal position cooperatively with the cover member being opened.

Accordingly, when the cover member is opened to receive the recording sheet in the sheet housing unit, the push member is displaced to a position away from the feed roller cooperatively with the cover member being opened. The push member is displaced to the distal position away from the feed roller in this manner to thereby create a space to accommodate the recording sheet between the push member and the feed roller, thereby facilitating accommodation of the recording sheet in the sheet housing unit. This also allows the operation of opening the cover member to displace the push member away from the feed roller, thereby ensuring a higher degree of operability.

The force application mechanism may comprise: a motor which produces a drive force; a plurality of gears which transfer the drive force to the push member; and an active member which is displaced by the drive force supplied by the plurality of gears and is brought into contact with the push member to allow push force to act upon the push member. The cooperation mechanism may disengage the gears cooperatively with the cover member being opened and thereby interrupts the transfer of drive force.

Accordingly, when the cover member is opened to receive the recording sheet in the sheet housing unit, no push force acts upon the push member. This makes it possible to readily displace the push member to a position away from the feed roller, thereby facilitating accommodation of the recording sheet in the sheet housing unit.

When the transfer of the drive force is interrupted, at least one force of a gravitational force acting upon the push member and a gravitational force acting upon the active member may cause the push member to displace toward the distal position.

Accordingly, when the cover member is opened to receive the recording sheet in the sheet housing unit, at least one of the gravitational forces acting upon the push member and the active member causes the push member to automatically displace toward the distal position. It is thus possible to facilitate accommodation of the recording sheet in the sheet housing unit and simplify the configuration of the device.

The force application mechanism may have a push force adjustment unit which controls the push force such that the push force remains generally constant.

Thus, it is possible to push the recording sheet housed in the sheet housing unit with improved stability toward the feed roller, as opposed to, for example, when compared with a case where an elastic unit such as a spring allows push force to act upon the push member.

The plurality of gears may comprise: an input gear disposed closer to the motor in a drive force transfer path leading from the motor to the active member; an output gear which directly transfers drive force to the active member; and an intermediate gear which transfers drive force from the input gear to the output gear and comprises a rotational shaft supported to be displaceable. The cooperation mechanism may displace the intermediate gear cooperatively with the cover member being opened to interrupt the transfer of drive force.

Thus, the intermediate gear may be displaced, and thus the active member needs not to be displaced. Accordingly, such problems can be prevented that an unnecessary increase in the number of parts to be moved causes degradation in positioning accuracy of those members and an increase in the actuating force for moving those members. The gang mechanism can be thus configured in a simple structure.

The cooperation mechanism may comprise a connecting link coupled to the cover member and the rotational shaft of the intermediate gear. The connecting link may be provided only on one end in a direction of a width of the recording sheet housed in the sheet housing unit.

The cooperation mechanism may displace the intermediate gear while engaging the input gear.

The cooperation mechanism may displace the intermediate gear so that the rotational shaft of the intermediate gear turns about a rotational shaft of the input gear.

Thus, the intermediate gear engages the input gear at any time, and therefore, the engagement can be reliable.

The cooperation mechanism may engage the plurality of gears cooperatively with the cover member being closed, and then holds the gears mated with each other.

Thus, the force application mechanism can be reliably actuated.

A restricting face may be provided at a bottom of the sheet housing unit and is in contact with a lower end of the recording sheet housed in the sheet housing unit to restrict a position of the housed recording sheet. The restricting face may be tilted with respect to a horizontal plane so as to be oriented upwardly from the push member toward the feed roller.

Thus, since the restricting face is tilted to be oriented upwardly, the tilted restricting face prevents the lower end of the recording sheets from being moved due to the gravitational force. Accordingly, the lower end of the recording sheets is prevented from unnecessarily moving, thereby avoiding the occurrence of the aforementioned problems.

According to another aspect of the present invention, there is provided a sheet feeding apparatus which comprises: a sheet housing unit which houses a recording sheet so that a recording surface of the recording sheet intersects with a horizontal plane, and which includes an opening portion formed on an upper end side thereof; a cover member configured to open and close the opening portion; a feed roller which feeds the recording sheet housed in the sheet housing unit; a push member provided in the sheet housing unit configured to push the recording sheet housed in the sheet housing unit toward the feed roller while moving between a distal position spaced apart from the feed roller and a proximal position closer to the feed roller than the distal position; a force application mechanism which provides a push force to the push member; and a cooperation mechanism which displaces the push member from the proximal position to the distal position cooperatively with the cover member being opened.

The present inventive concept, however, is not limited to the aforementioned aspects and exemplary embodiments, and various modifications may be made thereto without deviating from the scope and spirit of the invention set forth in the claims.

What is claimed is:

1. An image forming apparatus comprising:

an image forming unit which forms an image on a recording sheet;

a sheet housing unit which houses the recording sheet so that a recording surface of the recording sheet intersects with a horizontal plane, and which includes an opening portion formed on an upper end side thereof;

a cover member configured to open and close the opening portion;

a feed roller which feeds the recording sheet housed in the sheet housing unit to the image forming unit;

a push member provided in the sheet housing unit configured to push the recording sheet housed in the sheet housing unit toward the feed roller while moving between a distal position spaced apart from the feed roller and a proximal position closer to the feed roller than the distal position;

a force application mechanism which provides a push force to the push member; and a cooperation mechanism which displaces the push member from the proximal position to the distal position cooperatively with the cover member being opened, wherein the force application mechanism comprises:

a motor which produces a drive force;

a plurality of gears which transfer the drive force to the push member; and an active member which is displaced by the drive force supplied by the plurality of gears and is brought into contact with the push member to allow push force to act upon the push member, wherein the plurality of gears comprise:

an input gear disposed closer to the motor in a drive force transfer path leading from the motor to the active member;

an output gear which directly transfers drive force to the active member; and an intermediate gear which transfers drive force from the input gear to the output gear by meshing with the output gear and comprises a rotational shaft supported to be displaceable, and wherein the cooperation mechanism displaces the intermediate gear to disengage from one of the output gear and the input gear cooperatively with the cover member being opened to interrupt the transfer of drive force.

2. The image forming apparatus according to claim 1, wherein, when the transfer of the drive force is interrupted, at least one force of a gravitational force acting upon the push member and a gravitational force acting upon the active member causes the push member to displace toward the distal position.

3. The image forming apparatus according to claim 1, wherein the force application mechanism has a push force adjustment unit which controls the push force such that the push force remains generally constant.

4. The image forming apparatus according to claim 1, wherein the cooperation mechanism comprises a connecting link coupled to the cover member and the rotational shaft of the intermediate gear, and wherein the connecting link is provided only on one end in a direction of a width of the recording sheet housed in the sheet housing unit.

5. The image forming apparatus according to claim 1, wherein the cooperation mechanism displaces the intermediate gear to disengage from the output gear while engaging the input gear.

6. The image forming apparatus according to claim 1, wherein the cooperation mechanism displaces the intermediate gear so that the rotational shaft of the intermediate gear turns about a rotational shaft of the input gear.

7. The image forming apparatus according to claim 6, wherein force application mechanism has a bearing hole to guide the rotational shaft of the intermediate gear to rotationally move around the rotational shaft of the input gear.

8. The image forming apparatus according to claim 1, wherein the cooperation mechanism engages the intermediate gear and the one of the output gear and the input gear cooperatively with the cover member being closed, and then holds the intermediate gear and the one of the output gear and the input gear mated with each other.

9. The image forming apparatus according to claim 1, wherein a restricting face is provided at a bottom of the sheet housing unit and is in contact with a lower end of the recording sheet housed in the sheet housing unit to restrict a position of the housed recording sheet, and wherein the restricting face is tilted with respect to the horizontal plane so as to be oriented upwardly from the push member toward the feed roller.

10. The image forming apparatus according to claim 1, wherein the active member and the output gear are rotationally supported by a shaft different from the rotational shaft of the intermediate gear.

11. The image forming apparatus according to claim 1, wherein the cooperation mechanism has a hole which supports the rotational shaft of the intermediate gear.

12. A sheet feeding apparatus comprising:

a sheet housing unit which houses a recording sheet so that a recording surface of the recording sheet intersects with a horizontal plane, and which includes an opening portion formed on an upper end side thereof;

a cover member configured to open and close the opening portion;

a feed roller which feeds the recording sheet housed in the sheet housing unit;

a push member provided in the sheet housing unit configured to push the recording sheet housed in the sheet housing unit toward the feed roller while moving between a distal position spaced apart from the feed roller and a proximal position closer to the feed roller than the distal position;

a force application mechanism which provides a push force to the push member; and a cooperation mechanism which displaces the push member from the proximal position to the distal position cooperatively with the cover member being opened, wherein the force application mechanism comprises:

a motor which produces a drive force;

a plurality of gears which transfer the drive force to the push member; and an active member which is displaced by the drive force supplied by the plurality of gears and is brought into contact with the push member to allow push force to act upon the push member, wherein the plurality of gears comprise:

an input gear disposed closer to the motor in a drive force transfer path leading from the motor to the active member;

an output gear which directly transfers drive force to the active member; and an intermediate gear which transfers drive force from the input gear to the output gear by meshing with the output gear and comprises a rotational shaft supported to be displaceable, and wherein the cooperation mechanism displaces the intermediate gear to disengage from one of the output gear and the input gear cooperatively with the cover member being opened to interrupt the transfer of drive force.

13. An image forming apparatus comprising:

an image forming unit which forms an image on a recording sheet;

a sheet housing unit which houses the recording sheet so that a recording surface of the recording sheet intersects with a horizontal plane, and which includes an opening portion formed on an upper end side thereof;

a cover member configured to open and close the opening portion;

a feed roller which feeds the recording sheet housed in the sheet housing unit to the image forming unit;

a push member provided in the sheet housing unit configured to push the recording sheet housed in the sheet housing unit toward the feed roller while moving between a distal position spaced apart from the feed roller and a proximal position closer to the feed roller than the distal position;

a force application mechanism which provides a push force to the push member; and a cooperation mechanism which displaces the push member from the proximal position to the distal position cooperatively with the cover member being opened, wherein the push member is provided to extend in a substantially vertical direction, wherein the sheet housing unit includes a bottom face which faces an upper direction and supports a lower end of the recording sheet housed in the sheet housing unit, and wherein the bottom face is tilted with respect to the horizontal plane so as to be oriented upwardly toward the opening portion as approaching the feed roller.

14. The image forming apparatus according to claim 13, wherein the bottom face is curved to tilt upwardly toward the feed roller.

15. An image forming apparatus comprising:

an image forming unit which forms an image on a recording sheet;

a sheet housing unit which houses the recording sheet so that a recording surface of the recording sheet intersects with a horizontal plane, and which includes an opening portion formed on an upper end side thereof;

a cover member configured to open and close the opening portion;

a feed roller which feeds the recording sheet housed in the sheet housing unit to the image forming unit;

a push member provided in the sheet housing unit configured to push the recording sheet housed in the sheet housing unit toward the feed roller while moving between a distal position spaced apart from the feed roller and a proximal position closer to the feed roller than the distal position;

a force application mechanism which provides a push force to the push member; and a cooperation mechanism which displaces the push member from the proximal position to the distal position cooperatively with the cover member being opened, wherein the push member is provided to extend in a direction having a vertical component larger than a horizontal component, and wherein the cover member is provided to face an upper edge of the recording sheet housed in the sheet housing unit when closing the opening portion.

* * * * *